US010002573B2

(12) United States Patent
Teranuma

(10) Patent No.: US 10,002,573 B2
(45) Date of Patent: Jun. 19, 2018

(54) FIELD SEQUENTIAL DISPLAY DEVICE AND DRIVE METHOD THEREFOR

(71) Applicant: Sharp Kabushiki Kaisha, Osaka-shi, Osaka (JP)

(72) Inventor: Osamu Teranuma, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days. days.

(21) Appl. No.: 15/030,703

(22) PCT Filed: Sep. 25, 2014

(86) PCT No.: PCT/JP2014/075382
§ 371 (c)(1),
(2) Date: Apr. 20, 2016

(87) PCT Pub. No.: WO2015/087597
PCT Pub. Date: Jun. 18, 2015

(65) Prior Publication Data

US 2016/0240150 A1 Aug. 18, 2016

(30) Foreign Application Priority Data

Dec. 13, 2013 (JP) ..... 2013-257804

(51) Int. Cl.
*G09G 3/36* (2006.01)
*G09G 3/34* (2006.01)
*G09G 3/20* (2006.01)

(52) U.S. Cl.
CPC ..... *G09G 3/3413* (2013.01); *G09G 3/2003* (2013.01); *G09G 3/3426* (2013.01);
(Continued)

(58) Field of Classification Search
CPC .. G09G 3/2003; G09G 3/3413; G09G 3/3426; G09G 3/36; G09G 2310/0235; G09G 2310/08
(Continued)

(56) References Cited

U.S. PATENT DOCUMENTS

2005/0078069 A1* 4/2005 Aiba ..... G09G 3/3648 345/87
2005/0146492 A1* 7/2005 Baba ..... G02B 26/008 345/87
(Continued)

FOREIGN PATENT DOCUMENTS

JP 2002-311937 A 10/2002
JP 3690159 B2 8/2005
(Continued)

OTHER PUBLICATIONS

Official Communication issued in International Patent Application No. PCT/JP2014/075382, dated Nov. 25, 2014.

*Primary Examiner* — Amare Mengistu
*Assistant Examiner* — Nelson Lam
(74) *Attorney, Agent, or Firm* — Keating & Bennett, LLP

(57) ABSTRACT

The purpose of the present invention is to reduce the size of a circuit that generates display data and backlight data in each field. A field sequential data generation unit (10) is characterized by including a motion vector detection unit (11) for detecting motion vectors (MV) of input image data (D1), a backlight data generation unit (12) for generating backlight data (D2) based on the input image data, an image data calculation unit (13) for generating pre-interpolation display data (D3) based on image data (De) equivalent to the input image data and the backlight data, and an interpolation frame generation unit (14) for generating display data (D4) by performing frame interpolation processing which includes motion compensation using the motion vectors, on
(Continued)

the pre-interpolation display data. By using such a configuration, the backlight data is generated based on the input image data having not been subjected to the frame interpolation processing, and the size of the circuit is reduced.

8 Claims, 12 Drawing Sheets

(52) U.S. Cl.
CPC ..... *G09G 3/36* (2013.01); *G09G 2310/0235* (2013.01); *G09G 2310/08* (2013.01); *G09G 2320/0261* (2013.01); *G09G 2320/064* (2013.01); *G09G 2320/0646* (2013.01); *G09G 2320/106* (2013.01); *G09G 2340/0435* (2013.01); *G09G 2360/16* (2013.01)

(58) Field of Classification Search
USPC ..... 345/87–104
See application file for complete search history.

(56) References Cited

U.S. PATENT DOCUMENTS

2008/0253455 A1 10/2008 Van Zon et al.
2009/0096930 A1* 4/2009 Chen ..... H04N 5/145 348/699
2009/0153773 A1* 6/2009 Kuroda ..... G02F 1/133603 349/62
2009/0184916 A1* 7/2009 Miyazaki ..... G09G 3/3406 345/102
2009/0295839 A1 12/2009 Furukawa et al.
2010/0164856 A1* 7/2010 Liao ..... G09G 3/3225 345/102
2010/0214330 A1* 8/2010 Shishido ..... G09G 3/342 345/691
2010/0265281 A1 10/2010 Furukawa et al.
2011/0018891 A1* 1/2011 Peng ..... G09G 3/3611 345/589
2011/0249178 A1 10/2011 Asano et al.
2011/0273486 A1* 11/2011 Numao ..... G09G 3/3413 345/690
2012/0081419 A1* 4/2012 Abe ..... G09G 3/3426 345/691
2012/0287166 A1* 11/2012 Wyatt ..... G09G 5/006 345/690
2012/0287168 A1* 11/2012 Botzas ..... G09G 3/3413 345/690
2013/0010206 A1* 1/2013 Kohashikawa ..... G09G 3/3426 348/725
2016/0322004 A1* 11/2016 Yashiki ..... G09G 3/3426

FOREIGN PATENT DOCUMENTS

JP 2007-536863 A 12/2007
JP 2009-282098 A 12/2009
JP 2010-250061 A 11/2010
JP 2011-035656 A 2/2011
JP 2011-155431 A 8/2011
JP 2011-221292 A 11/2011
JP 2012-032627 A 2/2012
JP 5152084 B2 2/2013

* cited by examiner

FIELD SEQUENTIAL DISPLAY DEVICE AND DRIVE METHOD THEREFOR

TECHNICAL FIELD

The present invention relates to a display device, and more specifically relates to a field sequential type display device and a driving method therefor.

BACKGROUND ART

Liquid crystal display devices are widely used as display devices for displaying color images. Many conventional liquid crystal display devices display color images using color filters. Further, field sequential type liquid crystal display devices are known as a liquid crystal display device for displaying color images without using color filters.

Typically, a field sequential type liquid crystal display device is provided with a backlight including light sources of red, green, and blue, and displays three fields of red, green, and blue in one frame period. When the red field is to be displayed, a liquid crystal panel is driven based on red image data, and the red light source emits light. Then, the green field and the blue field are displayed in a similar manner. The three fields displayed by time division are combined based on an afterimage effect on an observer's retina, and thus would be recognized as a single color image by the observer.

In the field sequential type liquid crystal display device, the observer often sees colors of these three fields separated when a line of sight of the observer moves within a display screen (this phenomenon is called as a color breakup). Further, when an image moves quickly, an afterimage may be generated to cause blurring of the image or an unnatural motion of the image (this phenomenon is called as a judder). For suppressing the color breakup and judder, there have been conventionally known a method of performing frame rate conversion on image data, and a method of displaying a white field in addition to the red, green and blue fields. Apart from these methods, there is known a method of controlling the brightness of the backlight for each area in accordance with image data, as a method of reducing power consumption of the liquid crystal display device and increasing display contrast. The method of controlling the brightness of the backlight for each area may be used to suppress the color breakup.

As the field sequential type display device, the following techniques have been conventionally known. Patent Document 1 describes an image processing device for a time division color display device that performs frame interpolation processing (see FIG. 10). In FIG. 10, a motion detection circuit detects a motion direction and a motion amount of an image between frames of image data. A display position correction circuit corrects a display position of the image per field of each frame based on output of the motion detection circuit.

Patent Document 2 describes an image display device that controls brightness of a backlight for each area, and displays white, red, green, and blue fields (see FIG. 11). The image display device shown in FIG. 11 performs resolution reduction processing to input video signals Rorg, Gorg, Borg to obtain light emission patterns BLr, BLg, BLb of the backlight for each partial light emitting area. Then, the image display device generates partial driving video signals R, G, B by dividing the input video signals Rorg, Gorg, Borg by results obtained when diffusion processing is applied to the light emission patterns BLr, BLg, BLb, and extracts a common white component Wcom from the partial driving video signals R, G, B.

PRIOR ART DOCUMENTS

Patent Documents

[Patent Document 1] Japanese Patent No. 3690159
[Patent Document 2] Japanese Patent No. 5152084

SUMMARY OF THE INVENTION

Problems to be Solved by the Invention

Hereinafter, there is considered a field sequential type liquid crystal display device that controls a brightness of a backlight for each area and displays white, red, green and blue fields. A field sequential data generation unit of this liquid crystal display device can be configured using a frame rate conversion unit 81 and a field data generation unit 82, as shown in FIG. 12. The frame rate conversion unit 81 increases a frame rate of input image data fourfold. Based on the image data after the frame rate conversion, the field data generation unit 82 generates display data used for driving a liquid crystal panel and backlight data used for driving the backlight.

The frame rate conversion unit 81 performs motion compensation for enhancing the image quality. In the motion compensation, motion vectors are detected for each block having a predetermined size (e.g., (8×8) pixel block) based on input image data for two frames. For this reason, the motion compensation requires a large amount of computation. When generating the display data, the field data generation unit 82 obtains the brightness of the backlight at the position of each pixel of the liquid crystal panel based on a spatial distribution of light emitted from each light source included in the backlight. For this reason, the generation of the display data also requires a large amount of computation. The field sequential data generation unit shown in FIG. 12 thus has a problem of having a large circuit size.

Accordingly, an object of the present invention is to reduce a size of a circuit for generating display data and backlight data for each field in a field sequential type display device that controls a brightness of a backlight for each area.

Means for Solving the Problems

According to a first aspect of the present invention, there is provided a field sequential type display device including: a display panel including a plurality of pixels arranged two-dimensionally; a backlight including a plurality of types of light sources having different emission colors, each of the types including a plurality of light sources; a field sequential data generation unit configured to generate display data used for driving the display panel and backlight data used for driving the backlight, based on image data for each frame including a plurality of pieces of color component data; a panel drive circuit configured to drive the display panel based on the display data in accordance with a color of a field in each field period; and a backlight drive circuit configured to control the light source of one or more types in accordance with the color of the field to be in a light emitting state, based on the backlight data in accordance with the color of the field in each field period, wherein the field sequential data generation unit includes a motion vector detection unit configured to detect a motion vector of the image data, a backlight data generation unit configured to generate backlight data that shows a brightness of the light source in each area for each field based on the image data, the area being obtained by dividing the backlight into a plurality of areas, an image data calculation unit configured to generate pre-interpolation display data that is display data before performing frame interpolation processing, based on the image data, or data equivalent to the image data, and the backlight data, and an interpolation frame generation unit configured to generate the display data by performing frame interpolation processing which includes motion compensation using the motion vectors, on the pre-interpolation display data.

According to a second aspect of the present invention, in the first aspect of the present invention, the backlight data generation unit generates first backlight data showing the brightness of the light source in each area for each field based on the image data, and outputs as the backlight data a result of performing weighted-averaging of the first backlight data for successive two frames in a time-axis direction.

According to a third aspect of the present invention, in the first aspect of the present invention, the backlight data generation unit generates first backlight data showing the brightness of the light source in each area for each field based on the image data, and outputs as the backlight data a result of performing motion compensation based on output of the motion vector detection unit on the first backlight data.

According to a fourth aspect of the present invention, in the third aspect of the present invention, the backlight data generation unit obtains an average of the motion vectors for each of the areas to perform motion compensation, using the average of the motion vectors, on the first backlight data.

According to a fifth aspect of the present invention, in the third aspect of the present invention, the motion vector detection unit obtains low-resolution image data based on the image data to detect motion vectors of the low-resolution image data, and the backlight data generation unit performs motion compensation, using the motion vectors of the low-resolution image data, on the first backlight data.

According to a sixth aspect of the present invention, in the third aspect of the present invention, the motion vector detection unit detects a whole motion vector showing motion of a whole image based on the image data, and the backlight data generation unit performs motion compensation, using the whole motion vector, on the first backlight data.

According to a seventh aspect of the present invention, in the first aspect of the present invention, the backlight includes a plurality of red light sources, a plurality of green light sources, and a plurality of blue light sources, the image data includes red image data, green image data, and blue image data, and the field sequential data generation unit generates display data corresponding to white, red, green, and blue fields, and backlight data corresponding to white, red, green, and blue fields, based on the image data.

According to an eighth aspect of the present invention, there is provided a driving method for a field sequential type display device which includes a display panel including a plurality of pixels arranged two-dimensionally, and a backlight including a plurality of types of light sources having different emission colors, each of the types including a plurality of light sources; the method including the steps of: detecting a motion vector of image data for each frame including a plurality of pieces of color component data; generating backlight data that shows a brightness of the light source in each area for each field based on the image data, the area being obtained by dividing the backlight into a plurality of areas; generating pre-interpolation display data that is display data before performing frame interpolation processing, based on the image data, or data equivalent to the image data, and the backlight data; generating the display data for each field by performing frame interpolation processing which includes motion compensation using the motion vectors, on the pre-interpolation display data; driving the display panel based on the display data in accordance with a color of a field in each field period; and controlling the light source of one or more types in accordance with the color of the field to be in a light emitting state, based on the backlight data in accordance with the color of the field in each field period.

Effects of the Invention

According to the first or eighth aspect of the present invention, in the field sequential type display device for controlling the brightness of the backlight for each area, the backlight data is generated based on the image data having not been subjected to the frame interpolation processing. Hence, compared with the case of generating backlight data based on image data having been subjected to the frame interpolation processing, it is possible to reduce the amount of computation at the time of generation of the backlight data and reduce the size of the circuit for generating the backlight data and the display data for each field.

According to the second aspect of the present invention, the backlight data is generated by performing weighted-averaging of the first backlight data for two frames in the time-axis direction. The amount of computation in performing weighted-averaging of the first backlight data is not so large, but the accuracy of the backlight data is enhanced by the weighted-averaging. Hence more accurate backlight data can be generated by a small amount of computation, to reduce the color breakup and judder which occur on the display screen, thus enhancing the image quality of the display screen.

According to the third aspect of the present invention, the backlight data is generated by performing the motion compensation on the first backlight data. The amount of computation in performing the motion compensation on the first backlight data is not so large, but the accuracy of the backlight data is enhanced by the motion compensation. Hence more accurate backlight data can be generated by a small amount of computation, to reduce the color breakup and judder which occur on the display screen, thus enhancing the image quality of the display screen.

According to the fourth aspect of the present invention, the backlight data is generated by performing the motion compensation, using the average of the motion vectors for each area, on the first backlight data. Hence more accurate backlight data can be generated by a small amount of computation, to reduce the color breakup and judder which occur on the display screen.

According to the fifth aspect of the present invention, the backlight data is generated by performing the motion compensation, using the motion vectors of the low-resolution image data, on the first backlight data. Hence more accurate backlight data can be generated by a small amount of computation, to reduce the color breakup and judder which occur on the display screen.

According to the sixth aspect of the present invention, the backlight data is generated by performing the motion compensation, using the whole motion vector, on the first backlight data. Hence more accurate backlight data can be generated by a small amount of computation, to reduce the color breakup and judder which occur on the display screen.

According to the seventh aspect of the present invention, the white field can be displayed in addition to the red, green and blue fields to display each of the red, green and blue by two fields, and reduce the color breakup.

MODES FOR CARRYING OUT THE INVENTION

First Embodiment

Figure 1:
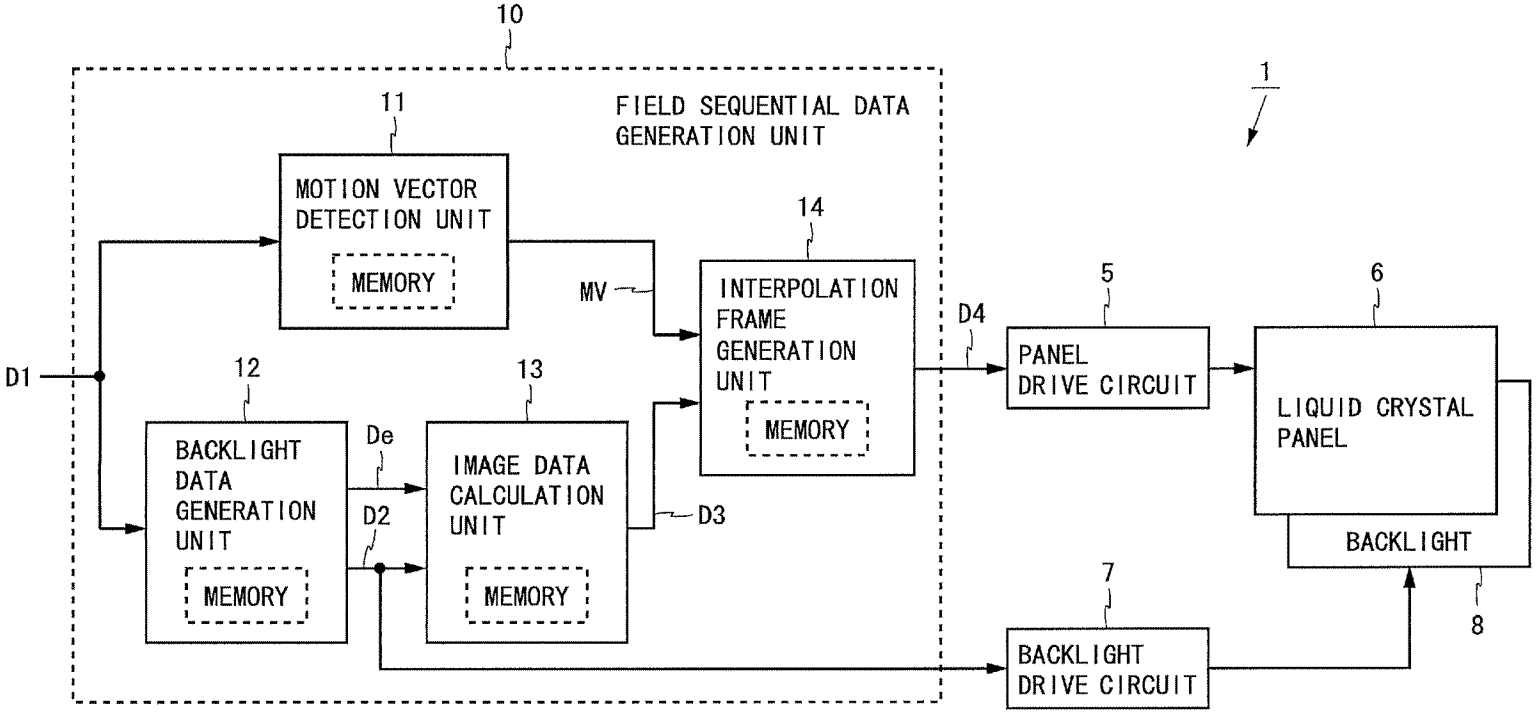
FIG. 1 is a block diagram showing a configuration of a liquid crystal display device according to a first embodiment of the present invention.

FIG. 1 is a block diagram showing a configuration of a liquid crystal display device according to a first embodiment of the present invention. A liquid crystal display device 1 shown in FIG. 1 includes a field sequential data generation unit 10, a panel drive circuit 5, a liquid crystal panel 6, a backlight drive circuit 7, and a backlight 8. The liquid crystal display device 1 performs field sequential drive, thereby to display four fields (white, red, green, and blue fields) in one frame period. Further, the liquid crystal display device 1 controls a brightness of the backlight 8 for each area in accordance with input image data D1. Hereinafter, it is assumed that p and q are integers not smaller than 2, s and t are integers not smaller than 1, and $s<p$ and $t<q$ are satisfied.

The liquid crystal panel 6 includes a plurality of pixels arranged two-dimensionally. More specifically, the liquid crystal panel 6 includes p scanning lines (not shown), q data lines (not shown), and (q×p) pixels (not shown). The p scanning lines extend in a horizontal direction (lateral direction in FIG. 1) of a display screen and arranged in parallel with each other. The q data lines extend in a vertical direction (longitudinal direction in FIG. 1) of the display screen and arranged in parallel with each other so as to be orthogonal to the p scanning lines. The (q×p) pixels are arranged corresponding to intersections of the p scanning lines and the q data lines.

The panel drive circuit 5 includes a scanning line drive circuit (not shown) and a data line drive circuit (not shown). The panel drive circuit 5 is supplied with display data D4 output from the field sequential data generation unit 10. The scanning line drive circuit sequentially selects the p scanning lines, and the data line drive circuit applies voltages in accordance with the display data D4 to the q data lines.

Figure 2:
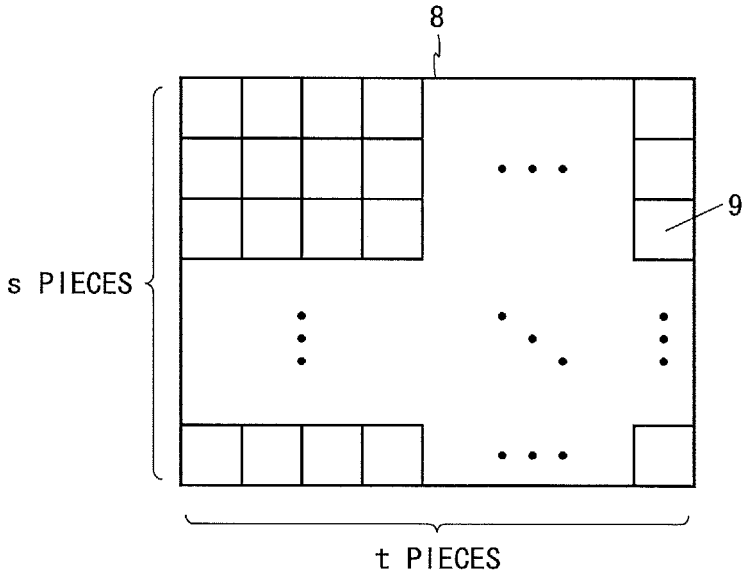
FIG. 2 is a view showing division of a backlight into areas in the liquid crystal display device shown in FIG. 1.

The backlight 8 includes a plurality of types of light sources having different light emission colors (red, green, and blue light sources), each of the types including a plurality of light sources. More specifically, the backlight 8 is an direct-type backlight including a plurality of LEDs (Light Emitting Diodes, not shown) arranged two-dimensionally. The plurality of LEDs includes red LEDs, green LEDs, and blue LEDs. As shown in FIG. 2, the backlight 8 is divided into s areas in the vertical direction (longitudinal direction in FIG. 2) and t areas in the horizontal direction (lateral direction in FIG. 2), and is thus divided into (t×s) areas 9 in total. Similarly, the liquid crystal panel 6 is divided into (t×s) areas. Each area 9 includes at least one red LED, one green LED, and one blue LED. Each area 9 may include only one red LED, one green LED, and one blue LED.

The backlight drive circuit 7 is supplied with backlight data D2 output from the field sequential data generation unit 10. The backlight data D2 shows the brightness of the LEDs in each area 9. The backlight drive circuit 7 drives the backlight 8 based on the backlight data D2.

The input image data D1 for each frame, including three pieces of color component data (red, green, and blue image data) is input to the liquid crystal display device 1 from externally. Each piece of color component data includes (q×p) pieces of data per frame. Based on the input image data D1, the field sequential data generation unit 10 generates the display data D4 used for driving the liquid crystal panel 6, and the backlight data D2 used for driving the backlight 8, for each field.

The display data D4 includes four pieces of display field data (white, red, green, and blue display field data). Each piece of display field data includes (q×p) pieces of data per field. The backlight data D2 includes four pieces of backlight field data (white, red, green, and blue backlight field data). Each piece of backlight field data includes (t×s) pieces of data per field. Hereinafter, it is assumed that a frame rate of the input image data D1 is 60 Hz, and a field rate of each of the display data D4 and the backlight data D2 is 240 Hz.

A specific example of the liquid crystal display device 1 is shown. In the liquid crystal display device 1, for example, it is assumed that p=1080, q=1920, s=10, and t=20, and that individual data included in each of the input image data D1, the backlight data D2, and the display data D4 is 8-bit data. In this case, (1920×1080×3) pieces of 8-bit data is input to the liquid crystal display device 1 as the input image data D1 at the frequency of 60 times per second. From the liquid crystal display device 1, (1920×1080) pieces of 8-bit data is output as the display data D4 at the frequency of 240 times per second, and (20×10) pieces of 8-bit data is output as the backlight data D2 at the frequency of 240 times per second. It is to be noted that this specific example is not to limit the scope of the present invention.

The field sequential data generation unit 10 includes a motion vector detection unit 11, a backlight data generation unit 12, an image data calculation unit 13, and an interpolation frame generation unit 14. All of these four constituents have a working memory.

The motion vector detection unit 11 detects motion vectors MV of the input image data D1. More specifically, the motion vector detection unit 11 detects motion vectors MV(n) for the current frame based on input image data D1($n$−1) for a previous frame which is stored in the memory, and input image data D1($n$) for the current frame which is input. The detected motion vectors MV(n) are used when a field to be inserted between the previous frame and the current frame is generated by interpolation processing (frame interpolation processing).

For example, the motion vector detection unit 11 divides the input image data D1 for each frame into blocks each having a predetermined size, and the motion vectors MV are detected per block based on the input image data D1($n$−1) for the previous frame and the input image data D1($n$) for the current frame. When p=1080, q=1920, and a block size is (8×8) pixels, the motion vector detection unit 11 detects (240×135) motion vectors MV at the frequency of 60 times per second. It is to be noted that the method for detecting the motion vectors MV in the motion vector detection unit 11 is arbitrary.

The backlight data generation unit 12 generates the backlight data D2 corresponding to the four fields based on the input image data D1. The backlight data D2 shows the brightness of the LED in each area 9 of the backlight 8. Further, the backlight data generation unit 12 outputs image data De which is obtained in the process of obtaining the backlight data D2 and is equivalent to the input image data D1.

First, the backlight data generation unit 12 converts the input image data D1 to four-color image data (white, red, green, and blue image data). When the red, green, and blue image data of one pixel included in the input image data D1 are respectively Ra, Ga, and Ba, the backlight data generation unit 12 performs computation shown in the following equations (1) to (4). "min" represents calculation for obtaining the minimum value.

$$Wb=\min(Ra,Ga,Ba) \quad (1)$$

$$Rb=Ra-Wb \quad (2)$$

$$Gb=Ga-Wb \quad (3)$$

$$Bb=Ba-Wb \quad (4)$$

The backlight data generation unit 12 outputs the image data De including Wb, Rb, Gb, Bb obtained by the equations (1) to (4). The image data De and the input image data D1 are convertible to each other, and the image data De is data equivalent to the input image data D1. It is to be noted that the method for converting the image data in the backlight data generation unit 12 is arbitrary. For example, as the value Wb, instead of using the minimum value of each of the image data Ra, Ga, Ba, the backlight data generation unit 12 may use a value obtained by multiplying the minimum value by k (0<k<1), or a value obtained by subtracting a positive constant value from the minimum value.

Next, for each area 9, the backlight data generation unit 12 obtains the maximum values Wm, Rm, Gm, Bm in the area 9 of the values Wb, Rb, Gb, Bb, and respectively obtains white, red, green, and blue backlight field data based on the obtained four maximum values Wm, Rm, Gm, Bm. According to this method, by making the white backlight field data as large as possible, the brightness at the time of individual light emission of the red LED, the green LED, and the blue LED can be suppressed to reduce the color breakup. It is to be noted that the method for generating the backlight data D2 in the backlight data generation unit 12 is arbitrary.

Based on the image data De and the backlight data D2, the image data calculation unit 13 generates display data D3 before performing the frame interpolation processing (hereinafter referred to as pre-interpolation display data D3), the pre-interpolation display data D3 corresponding to the four fields. For example, for each field, the image data calculation unit 13 obtains the brightness of the backlight 8 at the position of each pixel of the liquid crystal panel 6 based on the backlight data D2, and divides the brightness of each pixel included in the image data De by the brightness of the backlight 8 at the position of the pixel, to generate the pre-interpolation display data D3. It is to be noted that the method for generating the pre-interpolation display data D3 in the image data calculation unit 13 is arbitrary.

The interpolation frame generation unit 14 generates the display data D4 corresponding to the four fields by performing the frame interpolation processing which includes motion compensation using the motion vectors MV detected by the motion vector detection unit 11, on the pre-interpolation display data D3. For example, the interpolation frame generation unit 14 distributes the motion vectors MV to the respective four fields in accordance with the time-axial positions of the fields, and performs the motion compensation based on pre-interpolation display data D3($n$−1) for the previous frame stored in the memory, pre-interpolation display data D3($n$) for the current frame output from the image data calculation unit 13, and the distributed motion vectors, to generate white, red, green, and blue display field data. The interpolation frame generation unit 14 outputs the display data D4 including the four pieces of display field data. It is to be noted that the method for generating the display data D4 using the motion vectors MV in the interpolation frame generation unit 14 is arbitrary.

In the liquid crystal display device 1, one frame period is divided into four field periods (white, red, green, and blue field periods). In each field period, the field sequential data generation unit 10 outputs the display data D4 in accordance with the color of the field to the panel drive circuit 5, and outputs the backlight data D2 in accordance with the color of the field to the backlight drive circuit 7. For example, in the white field period, the field sequential data generation unit 10 outputs the white display field data to the panel drive circuit 5, and outputs the white backlight field data to the backlight drive circuit 7.

The panel drive circuit 5 drives the liquid crystal panel 6 based on the display data D4 in accordance with the color of the field in each field period. For example, in the white field period, the panel drive circuit 5 drives the liquid crystal panel 6 based on the white display field data. In each field period, the backlight drive circuit 7 controls the LED of one or more types in accordance with the color of the field to be in a light emitting state based on the backlight data D2 in accordance with the color of the field. Specifically, the backlight drive circuit 7 controls the red, green, and blue LEDs to be in the light emitting state in the white field period, controls the red LED to be in the light emitting state in the red field period, controls the green LED to be in the light emitting state in the green field period, and controls the blue LED to be in the light emitting state in the blue field period. In any field period, the backlight drive circuit 7 controls the LED in each area 9 so as to emit light with the brightness in accordance with the backlight data D2.

Figure 3:
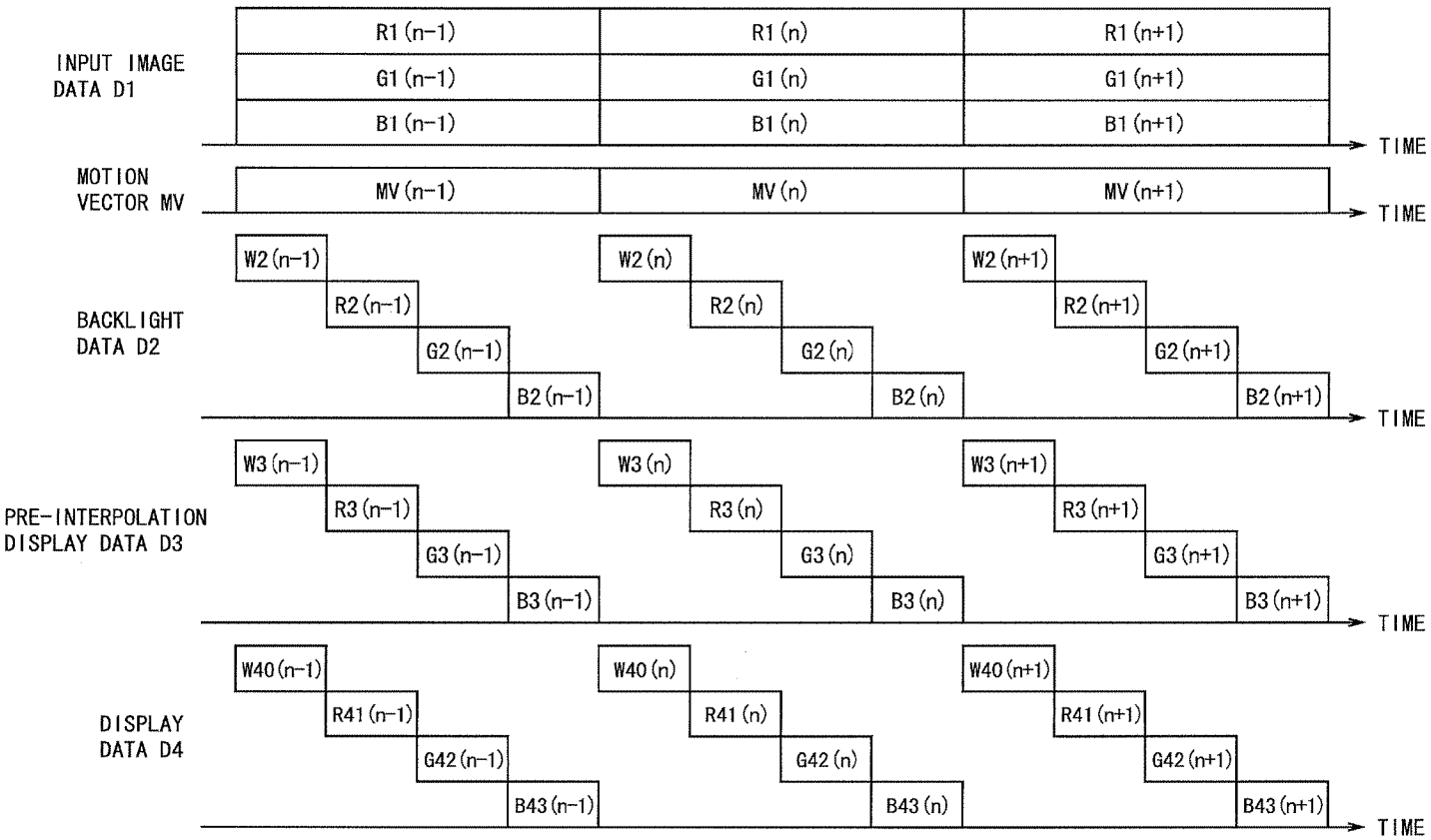
FIG. 3 is a diagram showing data generated by a field sequential data generation unit shown in FIG. 1.
Figure 5:
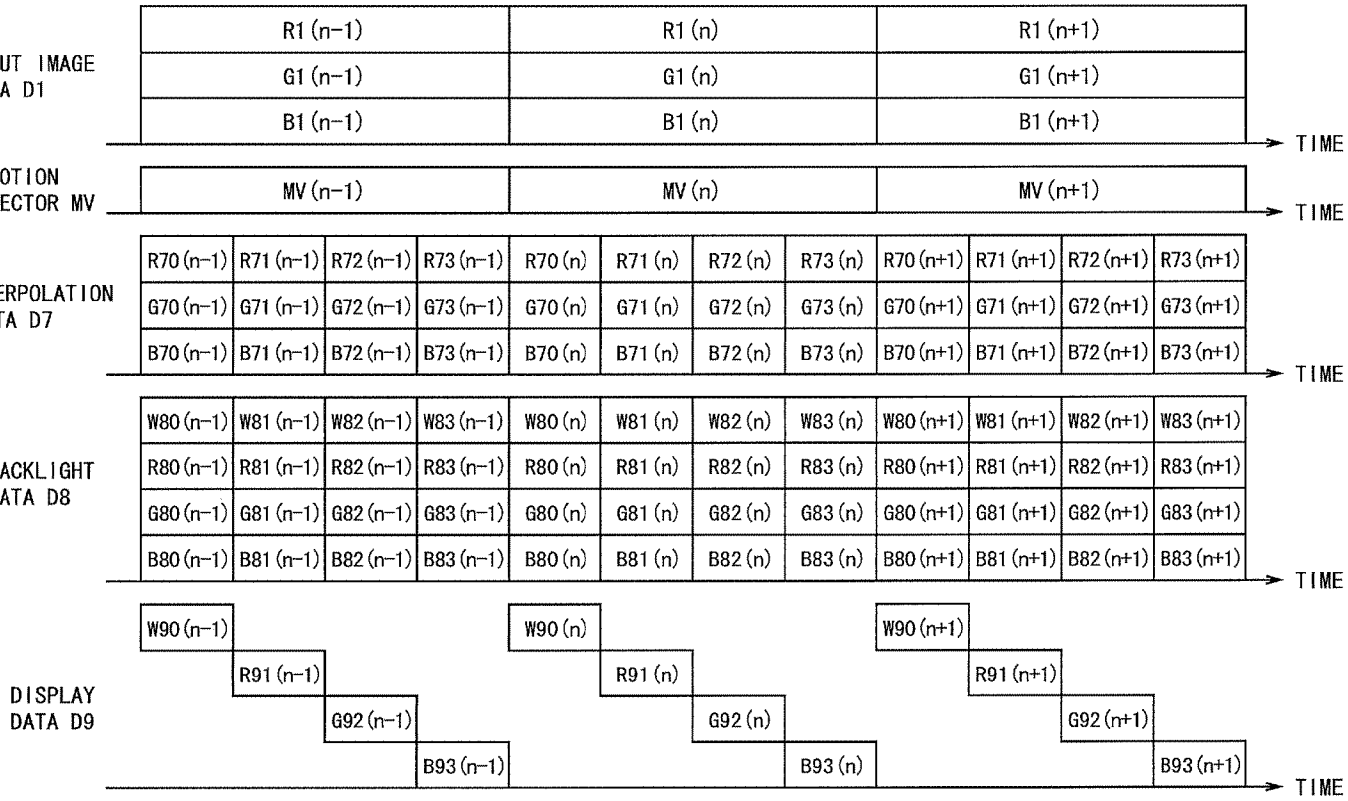
FIG. 5 is a diagram showing data generated by the field sequential data generation unit shown in FIG. 4.

FIG. 3 is a diagram showing data generated by the field sequential data generation unit 10. Hereinafter, in the drawings showing data (FIGS. 3, 5, and 7) and descriptions thereof, a character in a blanket represents a frame number. It is to be noted that FIGS. 3 and 5 schematically represent data amounts and computation amounts, and not accurately represent the timing for generating each data.

The field sequential data generation unit 10 performs the following processing on input image data D1(*n*) for the n-th frame, including three pieces of color component data R1(*n*), G1(*n*), B1(*n*). The motion vector detection unit 11 detects motion vectors MV of the input image data D1(*n*). The backlight data generation unit 12 generates image data De(n) (not shown) and backlight data D2(*n*) including four pieces of backlight field data W2(*n*), R2(*n*), G2(*n*), B2(*n*), based on the input image data D1(*n*). The image data calculation unit 13 generates pre-interpolation display data D3(*n*) including four pieces of pre-interpolation display field data W3(*n*), R3(*n*), G3(*n*), B3(*n*), based on the image data De(n) and the backlight data D2(*n*). The interpolation frame generation unit 14 generates display data D4(*n*) based on the pre-interpolation display data D3(*n*) and the motion vectors MV(n). The display data D4(*n*) includes white display field data W40(*n*), red display field data R41(*n*), green display field data G42(*n*), and blue display field data B43(*n*).

The liquid crystal display device 1 performs frame rate conversion, including motion compensation, on the input image data D1 to display the white field in addition to the red, green, and the blue fields, and controls the brightness of the backlight 8 for each area in accordance with the input image data D1. Thus, according to the liquid crystal display device 1, the color breakup and judder can be effectively suppressed.

Figure 4:
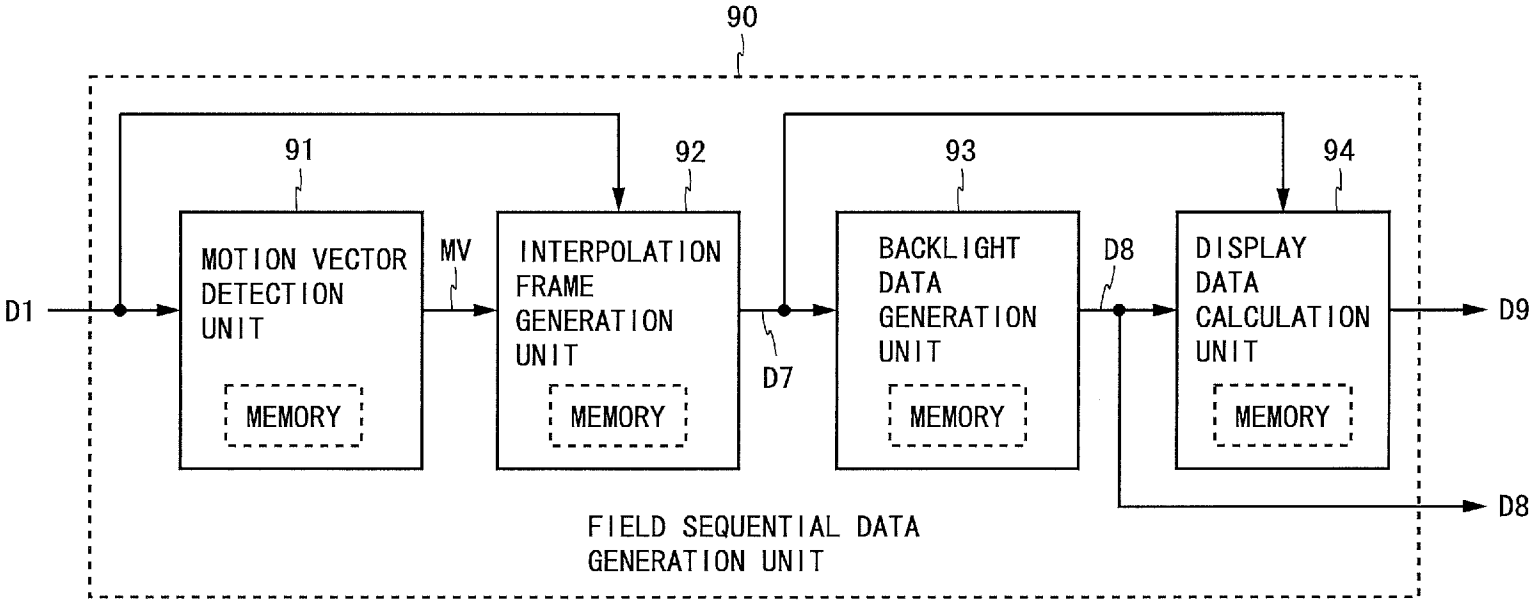
FIG. 4 is a block diagram showing a configuration of a field sequential data generation unit of a liquid crystal display device according to a comparative example.

Hereinafter, in contrast to a liquid crystal display device including a field sequential data generation unit 90 shown in FIG. 4 (hereinafter referred to as a liquid crystal display device according to a comparative example), an effect peculiar to the liquid crystal display device 1 according to the present embodiment is described. In FIG. 4, a motion vector detection unit 91 detects the motion vectors MV of the input image data D1. An interpolation frame generation unit 92 performs frame interpolation processing, which includes motion compensation using the motion vectors MV, on the input image data D1 to generate post-interpolation image data D7 corresponding to the four fields. A backlight data generation unit 93 generates backlight data D8 corresponding to the four fields based on the post-interpolation image data D7. A display data calculation unit 94 generates display data D9 based on the post-interpolation image data D7 and the backlight data D8.

FIG. 5 is a diagram showing data generated by the field sequential data generation unit 90. Based on the input image data D1(*n*) and the motion vectors MV(n), the interpolation frame generation unit 92 generates post-interpolation image data D7(*n*) corresponding to the four fields. Based on the post-interpolation image data D7(*n*), the backlight data generation unit 93 generates backlight data D8(*n*) corresponding to the four fields. In the liquid crystal display device according to the comparative example, the post-interpolation image data D7(*n*) includes 12 pieces of post-interpolation image field data R70(*n*), G70(*n*), and the like, and the backlight data D8(*n*) includes 16 pieces of backlight field data W80(*n*), R80(*n*), and the like.

The field sequential data generation unit 90 according to the comparative example performs the frame interpolation processing on the input image data D1, and generates the backlight data D8 and the display data D9 based on the image data having been subjected to the frame interpolation processing (the post-interpolation image data D7). Hence in the liquid crystal display device according to the comparative example, the data amounts of the post-interpolation image data D7 and the backlight data D8 are large, and the computation amounts at the time of generation of the post-interpolation image data D7 and the backlight data D8 are large. Further, since the motion vectors MV influence both the backlight data D8 and the display data D9, the backlight data D8 needs to be generated after detecting the motion vectors MV.

In contrast, the field sequential data generation unit 10 according to the present embodiment generates the backlight data D2 based on the image data having not been subjected to the frame interpolation processing (the input image data D1), and generates the display data D4 based on the motion vectors MV and the pre-interpolation display data D3. Hence, compared with the liquid crystal display device according to the comparative example, in the liquid crystal display device 1 according to the present embodiment, the data amounts of the backlight data D2 and the pre-interpolation display data D3 are small, and the computation amounts at the time of generation of the backlight data D2 and the pre-interpolation display data D3 are also small. Thus, according to the liquid crystal display device 1, it is possible to reduce the circuit size of the field sequential data generation unit 10. Further, since the motion vectors MV do not influence the backlight data D2, the backlight data D2 can be generated before detecting the motion vectors MV. Thus, according to the liquid crystal display device 1, the backlight data generation unit 12 and the image data calculation unit 13 are operated in parallel with the motion vector detection unit 11, thereby enabling reduction in time from the input of the input image data D1 to the output of the display data D4.

As described above, the field sequential data generation unit 10 of the liquid crystal display device 1 according to the present embodiment includes the motion vector detection unit 11 for detecting the motion vectors MV of the input image data D1, the backlight data generation unit 12 for generating the backlight data D2 that shows the brightness of the light source (LED) in each area 9 for each field based on the input image data D1, the area being obtained by dividing the backlight 8 into a plurality of areas 9, the image data calculation unit 13 for generating the pre-interpolation display data D3 based on the image data De (data equivalent to the input image data D1) and the backlight data D2, and the interpolation frame generation unit 14 for generating the display data D4 by performing the frame interpolation processing which includes the motion compensation using the motion vectors MV, on the pre-interpolation display data D3.

As thus described, in the liquid crystal display device 1, the backlight data D2 is generated not based on the image data having been subjected to the frame interpolation processing, but based on the image data having not been subjected to the frame interpolation processing (the input image data D1). Thus, according to the liquid crystal display device 1, compared with the case of generating the backlight data based on the image data having been subjected to the frame interpolation processing, it is possible to reduce the amount of computation at the time of generation of the backlight data D2 and reduce the circuit size of the circuit for generating the backlight data D2 and the display data D4 for each field (the field sequential data generation unit 10).

Based on the input image data D1, the field sequential data generation unit 10 generates the display data D4 corresponding to the white, red, green, and blue fields and the backlight data D2 corresponding to the white, red, green, and blue fields. Thus, according to the liquid crystal display device 1, the white field is displayed in addition to the red, green and blue fields, thereby to display each of the red, green and blue by two fields, thus enabling reduction in color breakup.

Second Embodiment

Figure 6:
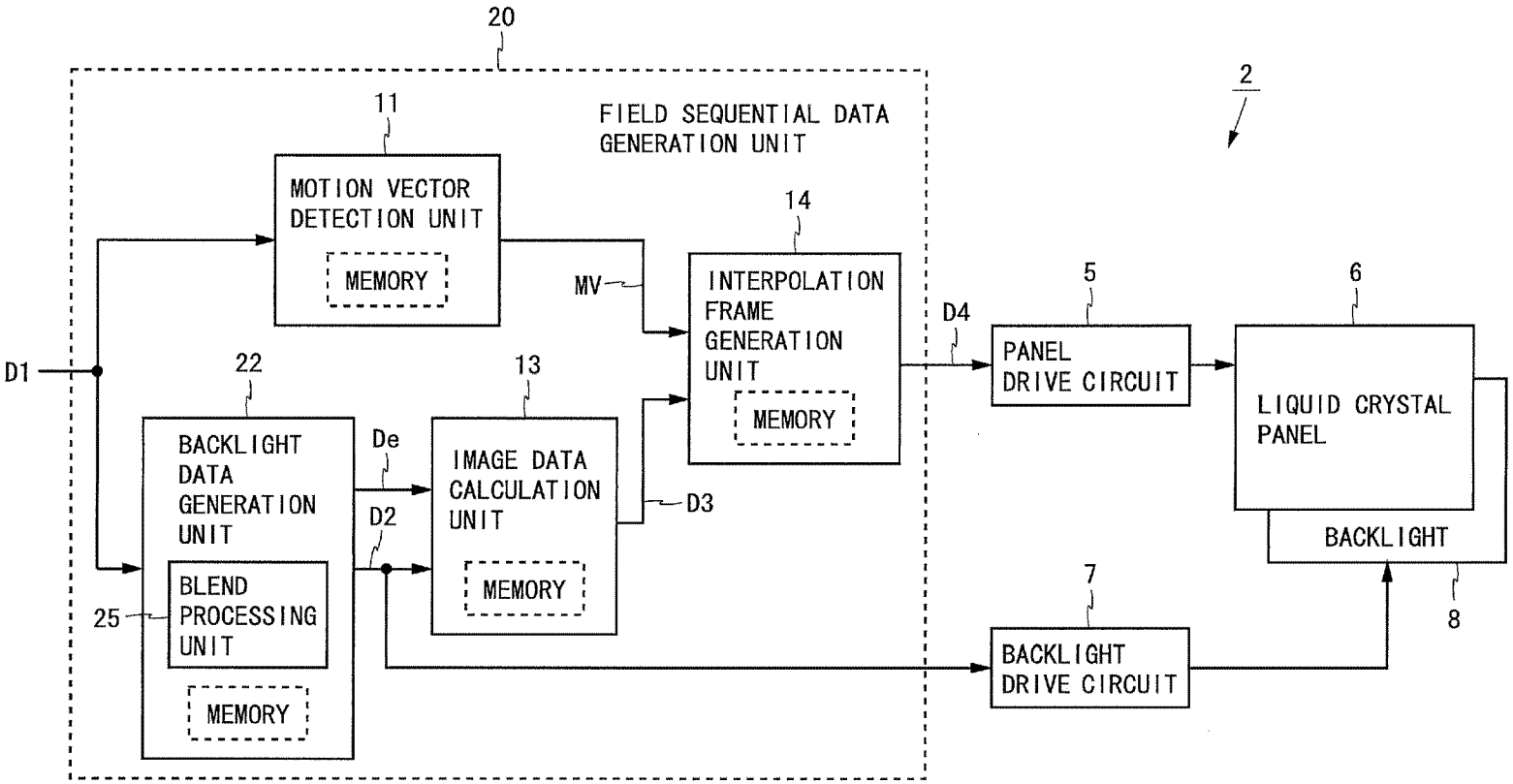
FIG. 6 is a block diagram showing a configuration of a liquid crystal display device according to a second embodiment of the present invention.

FIG. 6 is a block diagram showing a configuration of a liquid crystal display device according to a second embodiment of the present invention. A liquid crystal display device 2 shown in FIG. 6 is obtained based on the liquid crystal display device 1 according to the first embodiment by replacing the field sequential data generation unit 10 including the backlight data generation unit 12 with a field sequential data generation unit 20 including a backlight data generation unit 22. Of the constituents of the present embodiment, the same elements as those in the above first embodiment are provided with the same reference numerals, and descriptions thereof are omitted.

Similarly to the backlight data generation unit 12, the backlight data generation unit 22 generates backlight data corresponding to the four fields (hereinafter referred to as pre-blending backlight data) based on the input image data D1. The backlight data generation unit 22 includes a blend processing unit 25. The blend processing unit 25 performs weighted-averaging of pre-blending backlight data for successive two frames. The backlight data generation unit 22 outputs the output of the blend processing unit 25 as the backlight data D2.

The blend processing unit 25 performs calculation shown in the following equations (5) to (8), for example:

$$W20(n)=(1-Kw)W2(n)+Kw\times W2(n+1) \quad (5)$$

$$R21(n)=(1-Kr)R2(n)+Kr\times R2(n+1) \quad (6)$$

$$G22(n)=(1-Kg)G2(n)+Kg\times G2(n+1) \quad (7)$$

$$B23(n)=(1-Kb)B2(n)+Kb\times B2(n+1) \quad (8)$$

However, in the equations (5) to (8), W2($n$), R2($n$), G2($n$), and B2($n$) respectively represent the white, red, green, and blue backlight field data included in the pre-blending backlight data for the n-th frame. W2($n$+1), R2($n$+1), G2($n$+1), and B2($n$+1) respectively represent the white, red, green, and blue backlight field data included in the pre-blending backlight data for the (n+1)th frame. W20($n$), R21($n$), G22($n$), and B23($n$) respectively represent the white, red, green, and blue backlight field data included in the backlight data D2 for the n-th frame. Kw, Kr, Kg, and Kb represent constants not smaller than 0 and not larger than 1.

Figure 7:
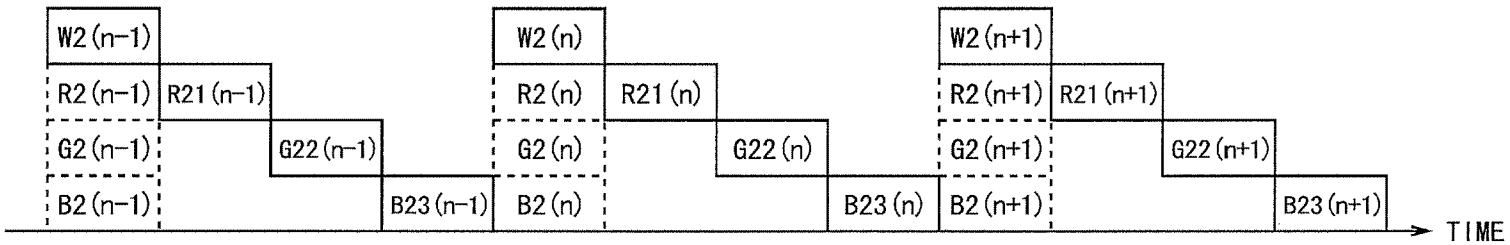
FIG. 7 is a diagram showing backlight data generated by a backlight data generation unit shown in FIG. 6.

Taking the n-th frame, the (n+1)th frame, and time-axial positions of the four fields into consideration, the four constants are set to Kw=0, Kr=0.25, Kg=0.5, and Kb=0.75 (see FIG. 7). In this case, the equations (5) to (8) are modified as follows.

$$W20(n)=W2(n)$$

$$R21(n)=0.75\times R2(n)+0.25\times R2(n+1)$$

$$G22(n)=0.5\times G2(n)+0.5\times G2(n+1)$$

$$B23(n)=0.25\times B2(n)+0.75\times B2(n+1)$$

It is to be noted that the blend processing unit 25 may perform weighted-averaging other than the above weighted-averaging.

As described above, in the liquid crystal display device 2 according to the present embodiment, the backlight data generation unit 22 generates the first backlight data (pre-blending backlight data) showing the brightness of the light source (LED) in each area 9 of the backlight 8 for each field, based on the input image data D1, and outputs as the backlight data D2 a result of performing weighted-averaging of the first backlight data for the successive two frames in the time-axis direction.

As thus described, in the liquid crystal display device 2, the backlight data D2 is generated by performing weighted-averaging of the first backlight data for the two frames in the time-axis direction. The amount of computation in the weighted-averaging of the first backlight data is not so large. Meanwhile, the accuracy of the backlight data D2 is enhanced by performing the weighted-averaging. Hence, according to the liquid crystal display device 2, more accurate backlight data can be generated by a small amount of computation, to reduce the color breakup and judder which occur on the display screen, thus enhancing the image quality of the display screen.

Third Embodiment

Figure 8:
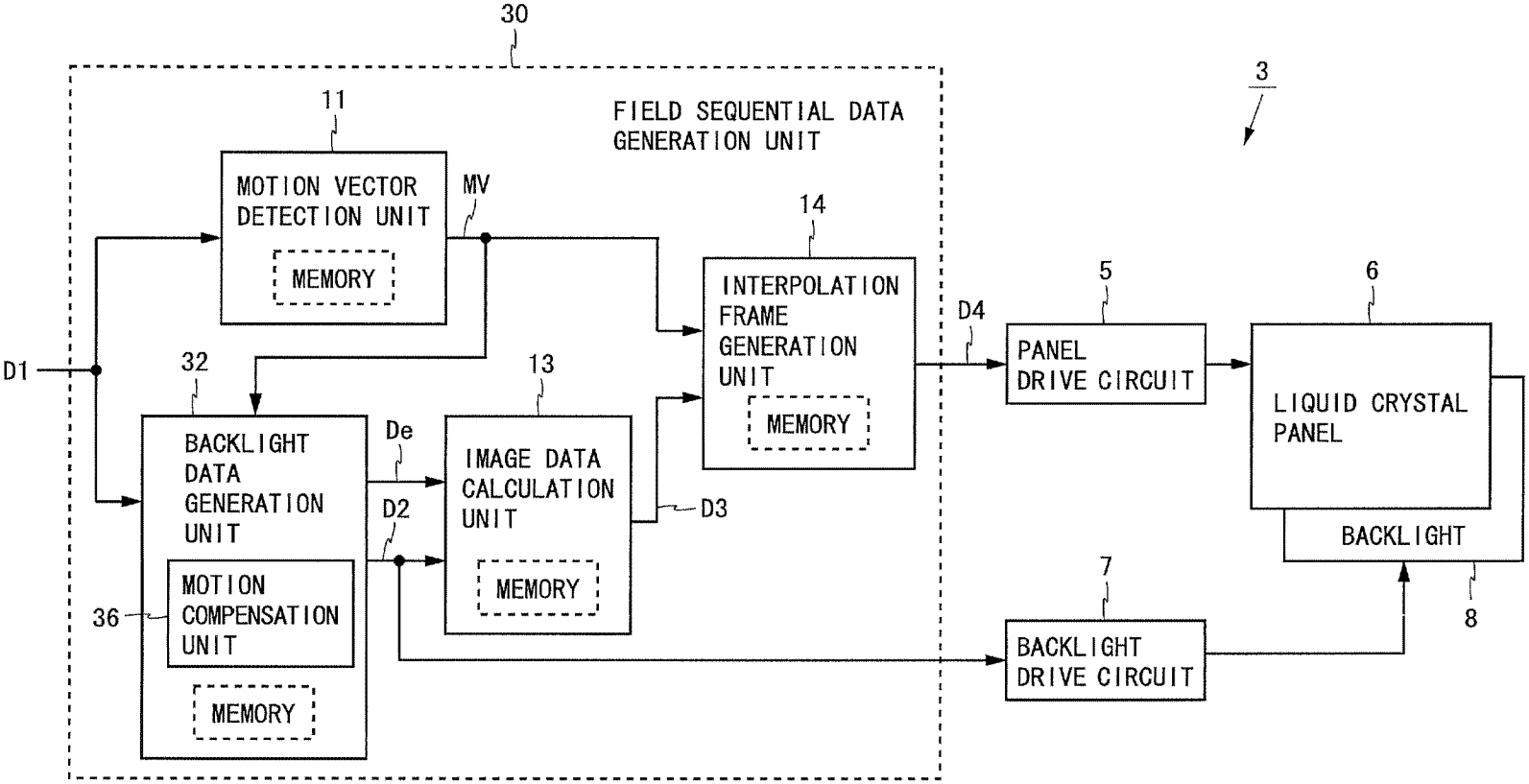
FIG. 8 is a block diagram showing a configuration of a liquid crystal display device according to a third embodiment of the present invention.

FIG. 8 is a block diagram showing a configuration of a liquid crystal display device according to a third embodiment of the present invention. A liquid crystal display device 3 shown in FIG. 8 is obtained based on the liquid crystal display device 1 according to the first embodiment by replacing the field sequential data generation unit 10 including the backlight data generation unit 12 with a field sequential data generation unit 30 including a backlight data generation unit 32. Of the constituents of the present embodiment, the same elements as those in the above first embodiment are provided with the same reference numerals, and descriptions thereof are omitted.

Similarly to the backlight data generation unit 12, the backlight data generation unit 32 generates backlight data corresponding to the four fields (hereinafter referred to as pre-motion-compensation backlight data) based on the input image data D1. The backlight data generation unit 32 includes a motion compensation unit 36. In the field sequential data generation unit 30, the motion vectors MV detected by the motion vector detection unit 11 are supplied to the interpolation frame generation unit 14 and the motion compensation unit 36.

The motion compensation unit 36 performs the motion compensation based on the motion vectors MV on the pre-motion-compensation backlight data. More specifically, the motion compensation unit 36 obtains an average of the motion vectors MV for each area 9 of the backlight 8, and performs the motion compensation, using the average of the motion vectors, on the pre-motion-compensation backlight data. The backlight data generation unit 32 outputs the output of the motion compensation unit 36 as the backlight data D2.

When a block size of the motion compensation is (8×8) pixels, the number of motion vectors MV detected by the motion vector detection unit 11 is (q/8×p/8) per frame. Meanwhile, the number of motion vectors required in the motion compensation unit 36 is (t×s) per frame. Generally, s is sufficiently smaller than p, and t is also sufficiently smaller than q. For this reason, the number of motion vectors required in the motion compensation unit 36 is smaller than the number of motion vectors MV detected by the motion vector detection unit 11 (i.e., the number of motion vectors required in the interpolation frame generation unit 14).

As described above, in the liquid crystal display device 3 according to the present embodiment, the backlight data generation unit 32 generates the first backlight data showing the brightness of the light source (LED) in each area 9 of the backlight 8 for each field (the pre-motion-compensation backlight data) based on the input image data D1, and outputs as the backlight data D2 a result of performing the motion compensation based on output of the motion vector detection unit 11 on the first backlight data. The backlight data generation unit 32 obtains an average of the motion vectors MV detected by the motion vector detection unit 11 for each area 9 of the backlight 8, to perform the motion compensation, using the average of the motion vectors, on the first backlight data.

As thus described, in the liquid crystal display device 3, the backlight data D2 is generated by performing the motion compensation, using the average of the motion vectors MV for each area 9 of the backlight 8, on the first backlight data. The amount of computation in performing the motion compensation on the first backlight data is not so large. Meanwhile, the accuracy of the backlight data D2 is enhanced by performing the motion compensation. Hence more accurate backlight data can be generated by a small amount of computation, to reduce the color breakup and judder which occur on the display screen, thus enhancing the image quality of the display screen.

Modified examples of the liquid crystal display device 3 according to the present embodiment can be configured as follows. In a liquid crystal display device according to a first modified example, the motion vector detection unit obtains low-resolution image data based on the input image data D1, to detect motion vectors of low-resolution image data. The backlight data generation unit performs the motion compensation, using the motion vectors of the low-resolution image data, on the pre-motion-compensation backlight data. In a liquid crystal display device according to a second modified example, the motion vector detection unit detects only one whole motion vector showing motion of the whole image based on the input image data D1. The backlight data generation unit performs the motion compensation, using the whole motion vector, on the pre-motion-compensation backlight data. The liquid crystal display devices according to these modified examples have the same effect as that of the liquid crystal display device 3 according to the third embodiment.

In the above description, the image data calculation unit 13 generates the pre-interpolation display data D3 based on the image data De (data equivalent to the input image data D1) and the backlight data D2. Instead of this, the image data calculation unit 13 may generate the pre-interpolation display data D3 based on the input image data D1 and the backlight data D2. As thus described, the image data calculation unit 13 may generate the pre-interpolation display data D3 based on the input image data D1, or the data equivalent to the input image data D1, and the backlight data D2.

Figure 9:
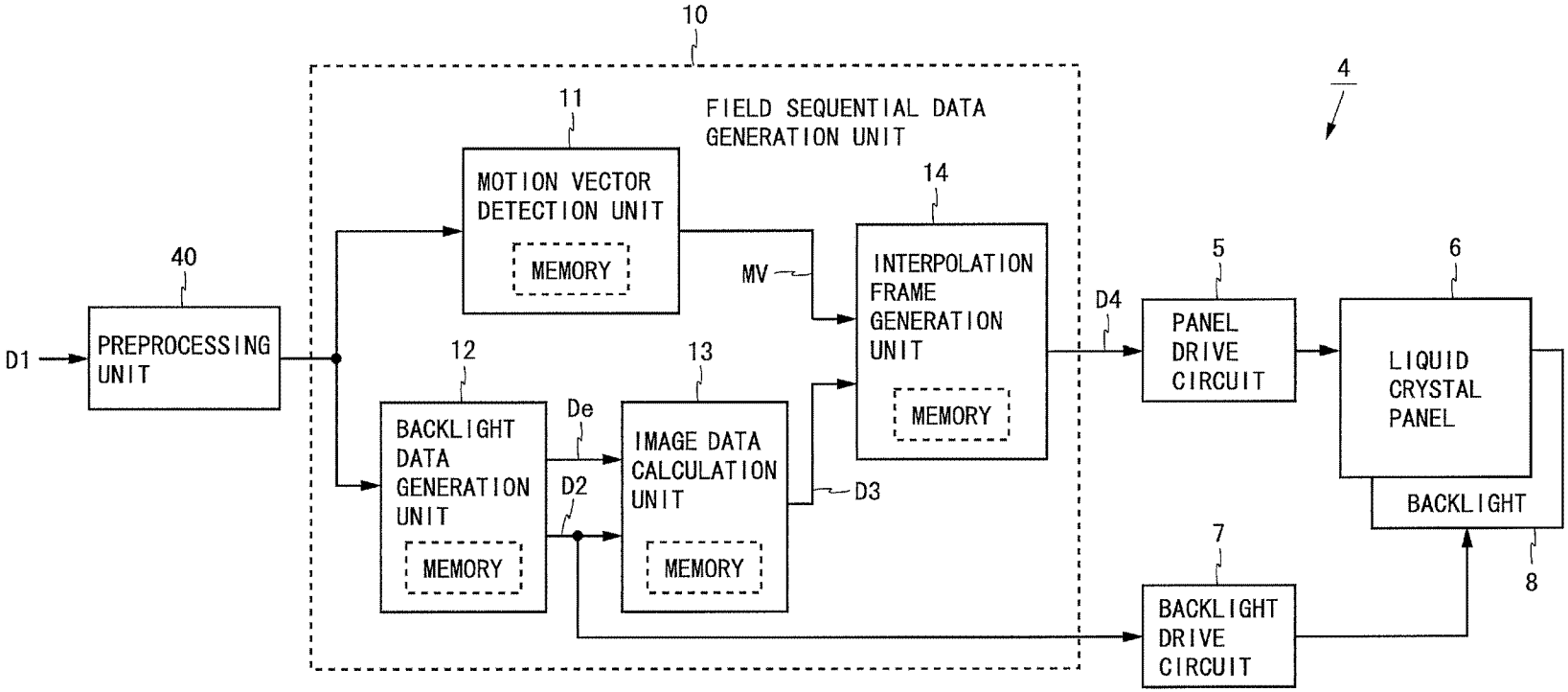
FIG. 9 is a block diagram showing a configuration of a liquid crystal display device according to a modified example of the present invention.
Figure 10:
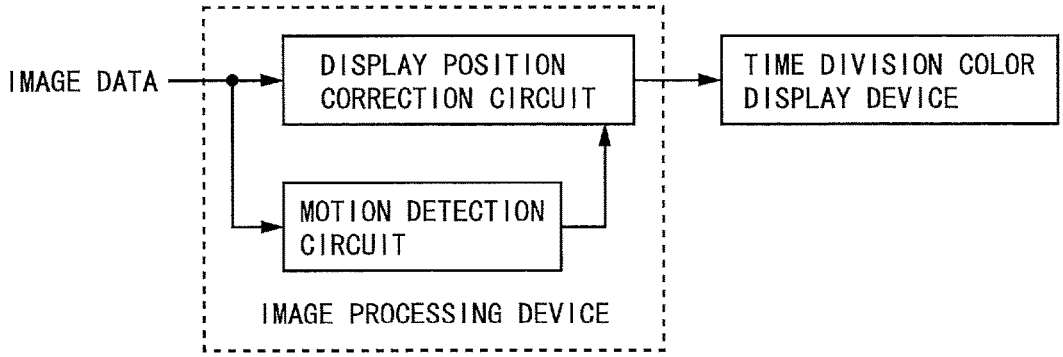
Fig. 10 PRIOR ART
FIG. 10 is a block diagram showing a configuration of a conventional image processing device.
Figure 11:
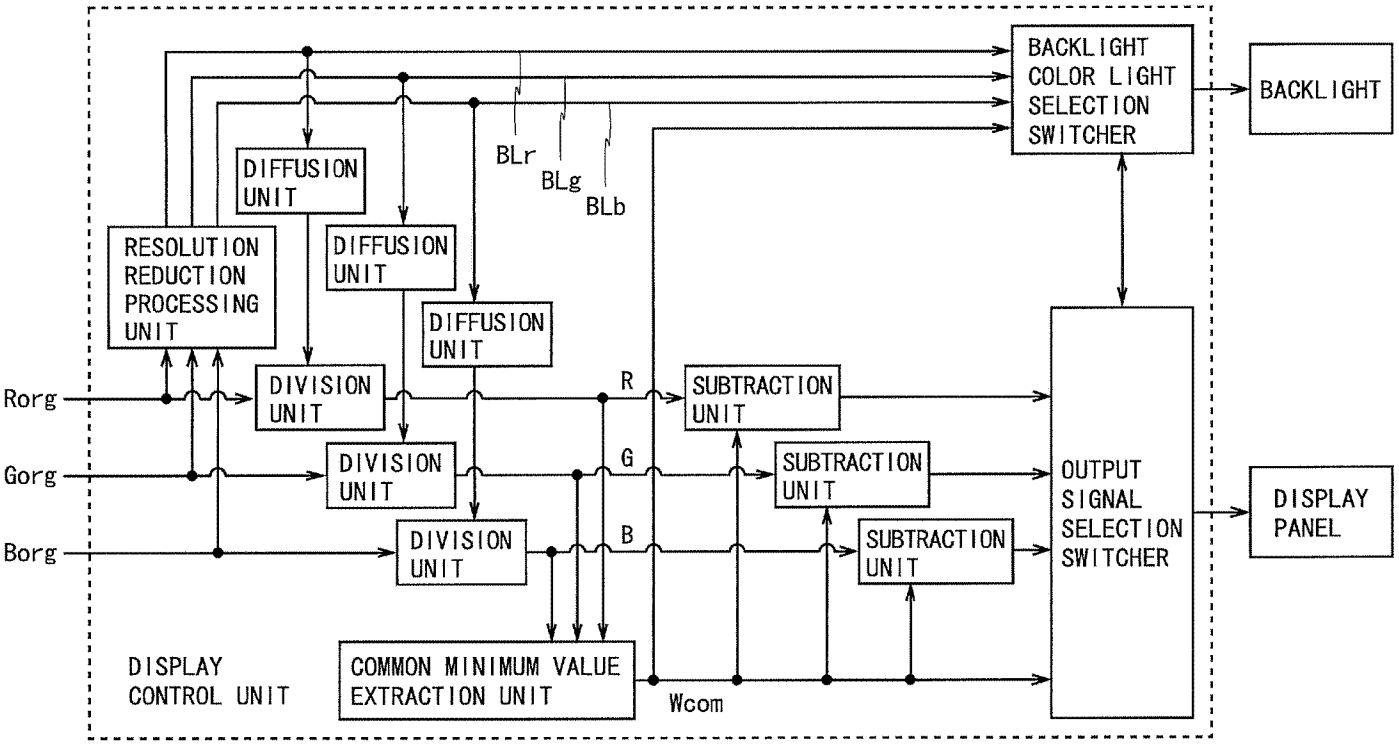
Fig. 11 PRIOR ART
FIG. 11 is a block diagram showing a configuration of a conventional image display device.
Figure 12:
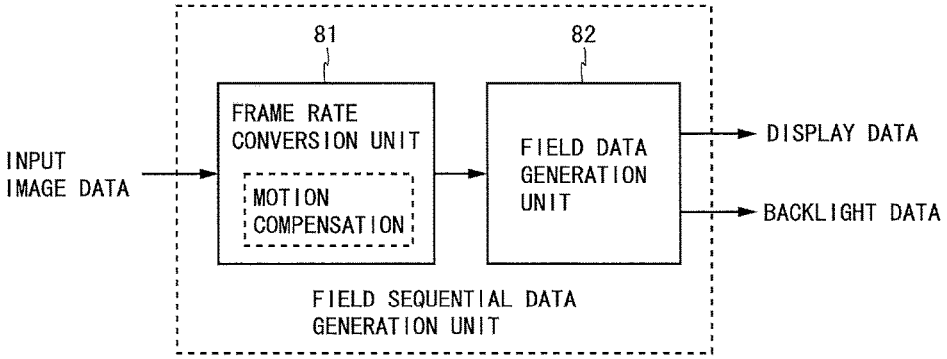
Fig. 12 PRIOR ART
FIG. 12 is a block diagram showing a configuration of a conventional field sequential data generation unit.

Further, the liquid crystal display device of the present invention may include a preprocessing unit for performing preprocessing on the input image data D1, in a previous stage of the field sequential data generation unit. For example, adding a preprocessing unit 40 to the liquid crystal display device 1 according to the first embodiment enables configuration of a liquid crystal display device 4 shown in FIG. 9.

Moreover, in the display device of the present invention, the frame rate of the input image data, the number of fields in one frame period, the display order of the fields, and the like are arbitrary. For example, the display device of the present invention may display the white, red, green, and blue fields at a field rate of 300 Hz based on input image data having a frame rate of 60 Hz. Alternatively, the display device of the present invention may display the four fields in one frame period in order other than the order of white, red, green, and blue. Further, the display device of the present invention is not limited to the display device for displaying the four fields which are the white, red, green, and blue fields in one frame period, but may be a display device for displaying arbitrary four or more fields in one frame period. Moreover, in a display device for displaying fields such as cyan, magenta and yellow fields, a backlight data generation unit may use an arbitrary conversion method at the time of conversion of red, green, and blue image data to image data with four or more colors. Furthermore, the present invention is not limited to the liquid crystal display device, but is applicable to a field sequential type display device for controlling the brightness of the backlight for each area.

INDUSTRIAL APPLICABILITY

The display device of the present invention has a characteristic of being able to reduce a size of a circuit for generating display data and backlight data for each field, and the device is thus usable for display units of a variety of electronic devices, and the like.

DESCRIPTION OF REFERENCE CHARACTERS

1, 2, 3, 4: liquid crystal display device
5: panel drive circuit
6: liquid crystal panel
7: backlight drive circuit
8: backlight
9: area
10, 20, 30: field sequential data generation unit
11: motion vector detection unit
12, 22, 32: backlight data generation unit
13: image data calculation unit
14: interpolation frame generation unit
25: blend processing unit
36: motion compensation unit
40: preprocessing unit

The invention claimed is:

1. A field sequential type display device comprising:

a display panel including a plurality of pixels arranged two-dimensionally;

a backlight including a plurality of types of light sources having different emission colors, each of the types including a plurality of light sources;

a field sequential data generation unit configured to generate display data used for driving the display panel and backlight data used for driving the backlight, based on image data for each frame including a plurality of pieces of color component data;

a panel drive circuit configured to drive the display panel based on the display data in accordance with a color of a field in each field period; and a backlight drive circuit configured to control the light source of one or more types in accordance with the color of the field to be in a light emitting state, based on the backlight data in accordance with the color of the field in each field period, wherein the field sequential data generation unit includes a motion vector detection unit configured to detect a motion vector of the image data, a backlight data generation unit configured to generate backlight data that shows a brightness of the light source in each area for each field based on the image data, the area being obtained by dividing the backlight into a plurality of areas, an image data calculation unit configured to generate pre-interpolation display data that is display data before performing frame interpolation processing, based on the image data, or data equivalent to the image data, and the backlight data, and an interpolation frame generation unit configured to generate the display data by performing frame interpolation processing which includes motion compensation using motion vectors, on the pre-interpolation display data, and the backlight data generation unit and the image data calculation unit operate in parallel with the motion vector detection unit.

2. The display device according to claim 1, wherein the backlight data generation unit generates first backlight data showing the brightness of the light source in each area for each field based on the image data, and outputs as the backlight data a result of performing weighted-averaging of the first backlight data for successive two frames in a time-axis direction.

3. The display device according to claim 1, wherein the backlight data generation unit generates first backlight data showing the brightness of the light source in each area for each field based on the image data, and outputs as the backlight data a result of performing motion compensation based on output of the motion vector detection unit on the first backlight data.

4. The display device according to claim 3, wherein the backlight data generation unit obtains an average of the motion vectors for each of the areas to perform motion compensation, using the average of the motion vectors, on the first backlight data.

5. The display device according to claim 3, wherein the motion vector detection unit obtains low-resolution image data based on the image data to detect motion vectors of the low-resolution image data, and the backlight data generation unit performs motion compensation, using the motion vectors of the low-resolution image data, on the first backlight data.

6. The display device according to claim 3, wherein the motion vector detection unit detects a whole motion vector showing motion of a whole image based on the image data, and the backlight data generation unit performs motion compensation, using the whole motion vector, on the first backlight data.

7. The display device according to claim 1, wherein the backlight includes a plurality of red light sources, a plurality of green light sources, and a plurality of blue light sources, the image data includes red image data, green image data, and blue image data, and the field sequential data generation unit generates display data corresponding to white, red, green, and blue fields, and backlight data corresponding to white, red, green, and blue fields, based on the image data.

8. The display device according to claim 1, wherein the image data not subjected to the frame interpolation processing is input to the backlight data generation unit.

* * * * *